US006496985B1

(12) United States Patent
Faldet

(10) Patent No.: US 6,496,985 B1
(45) Date of Patent: Dec. 24, 2002

(54) SHAMPOO CAPE DEVICE

(76) Inventor: Kristina M. Faldet, R.R. #2, Box 94M, Erskine, MN (US) 56535

( * ) Notice: Subject to any disclaimer, the term of this patent is extended or adjusted under 35 U.S.C. 154(b) by 0 days.

(21) Appl. No.: 09/870,231

(22) Filed: May 30, 2001

(51) Int. Cl.[7] ..... A41B 13/10; A41D 13/00
(52) U.S. Cl. ..... 2/50; 2/46
(58) Field of Search ..... 2/50, 174, 48, 2/88, 46, 49, 52

(56) References Cited

U.S. PATENT DOCUMENTS 1,165,533 A * 12/1915 Nelson
1,660,124 A * 2/1928 Grom
2,526,505 A * 10/1950 Richmond ..... 2/50
2,674,739 A * 4/1954 Barnett ..... 2/50
2,892,909 A * 6/1959 Darnutzer et al.
2,947,004 A * 8/1960 Pfile ..... 2/50
2,984,840 A * 5/1961 Parco
3,031,676 A * 5/1962 Larson
4,014,054 A * 3/1977 Pasquarello ..... 4/159
4,139,912 A * 2/1979 Thuaud ..... 2/50
4,280,227 A * 7/1981 Brock ..... 2/88
4,615,047 A * 10/1986 Matsuoka ..... 2/50
4,689,830 A * 9/1987 Williams ..... 2/50
4,709,420 A * 12/1987 Gettinger ..... 2/50
4,710,980 A * 12/1987 Brison et al. ..... 2/50
5,079,777 A * 1/1992 Fowler et al. ..... 2/50
5,469,580 A * 11/1995 Sobol ..... 2/50
5,572,740 A * 11/1996 Geniesse ..... 2/46
5,950,236 A * 9/1999 Andrew et al. ..... 2/50
5,953,753 A * 9/1999 Perez ..... 2/50
5,991,919 A * 11/1999 Baggetto ..... 2/50
6,094,744 A * 8/2000 Dibenedetto et al. ..... 2/50
6,131,197 A * 10/2000 Wang ..... 2/50
6,195,799 B1 * 3/2001 Davies ..... 2/50

* cited by examiner

*Primary Examiner*—John J. Calvert
*Assistant Examiner*—Alissa L. Hoey
(74) *Attorney, Agent, or Firm*—Robert E. Kleve

(57) ABSTRACT

The invention comprises a shampoo cape having a rear panel and a pair of front panels. Each panel have top edges with the top inner edges of the front panels connected to the top intermediate portions of the rear panel with space there between for a neck portion to the cape, the front top edges of each of the front panels are connected to the top edges of the rear panel along a direction extending laterally outward a distance and then extending laterally outward and downward with the lateral top outer edges of the front panels connected to the lateral top outer edges of the rear panel. The lateral outward and then lateral outward and then downward portions each form a cup like shape extending downward. The top inner edges of the front panels have means to secure the panels together whereupon when the cape is placed over the shoulders of a wearer seeking a shampoo, the downward cup portions of the cape may be inverted upward to cause the lateral outer edges of the rear panel that extend rearward to form channels to the rear panel so that the rear panel may be draped into the sink while the person seeking a shampoo is wearing the cape, the channels will act to guide fluids used in shampooing more directly rearward into the sink.

3 Claims, 1 Drawing Sheet

SHAMPOO CAPE DEVICE

This invention relates to neck capes, more particularly, the invention relates to a shampoo cape.

It is an object of the invention to provide a novel shampoo cape having a back panel and a pair of front panels connected at their outer edges to the back panel and which overlap at the front with the front panels connected at each outer shoulder to the back panel to form channels along the outer sides of the back panel to channel fluids during shampooing with the cape attached to the person seeking the shampoo to channel the fluids rearwardly along the outer edges of the back panel in a rearward direction.

It is another object of the invention to provide a novel shampoo cape having a back panel and a pair of front panels each connected at heir outer edges to the back panel with an upward extending outside edge formed on each outer side of the back panel to channel fluids rearward along the outer edges of the back panel when the cape is worn by a person seeking a shampoo so that fluids may used during shampooing may be channeled rearward along the outside edges of the back panel Further objects and advantages of the invention will become apparent as the description proceeds and when taken in conjunction with accompanying drawing wherein:

BRIEF DESCRIPTION OF PREFERRED EMBODIMENT

Briefly stated, the invention comprises a shampoo cape having a rear panel and a pair of front panels. Each panel has top edges with the top inner edges of the front panels connected to the top intermediate edge portions of the rear panel with space between for a neck portion. The top edges of each of the front panels are connected to the top edges of the rear panel along a direction laterally outward for a distance and then laterally outward and downward with the lateral top outer edges of the front panel connected to the lateral top outer edges of the rear panel. The top lateral outward and then outward and downward portions of the cape each form a cup like shape extending downward. The top inner edges of the front panels have means to secure them together when the cape is placed over the shoulders of a wearer seeking a shampoo. The downward cup portions of the cape may be inverted to cause the lateral outer edges of the rear panel that extend rearward to form channels to the rear panel, so that the rear panel may be draped into a sink, while the person seeking the shampoo is wearing the cape, and the channels will act to guide fluids used in shampooing more directly rearward into the sink.

Figure 1:
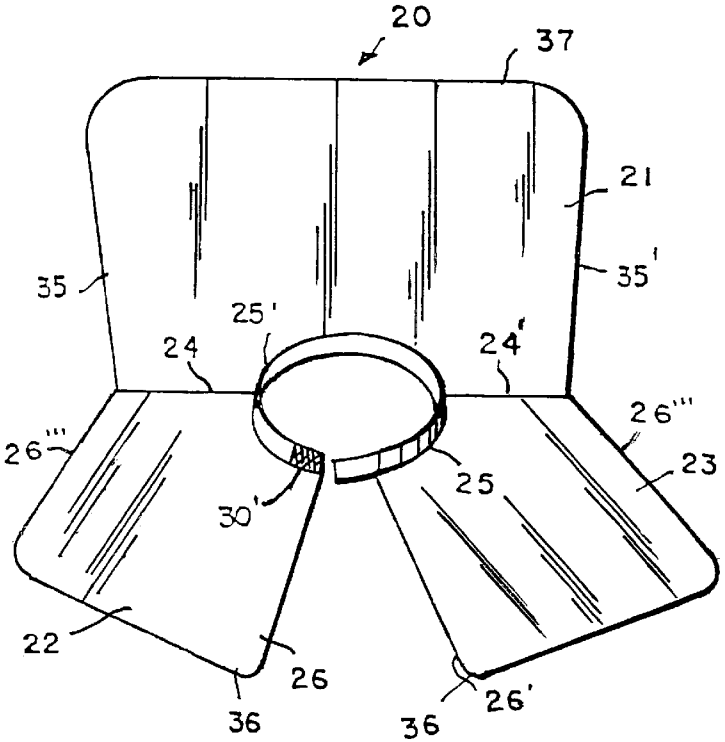
FIG. 1 is a front elevational view of the shampoo cape invention.

Referring more particularly to the drawing, in FIG. 1, the shampoo cape invention 20 is illustrated having a back panel

21 and a pair of front panels 22 and 23. The front panels 22 and 23 are sewn at their top edges to the top edges of the back panel 21 long lines 24 and 24'. An up-turned collar 25 is sewn about a center opening 25' in the front and rear panels.

Figure 2:
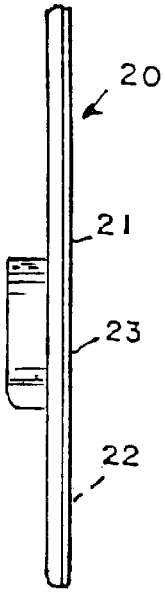
FIG. 2 is a side elevational view of the shampoo cape invention.

The outer top connections between the front and back panels of the device are pre formed drawn closer to one another at their outer front edges 26''' than their inner front edges 26 and 26' along lines 24 and 24' when the device is placed flat upon a surface as shown in FIG. 2 to cause the panels 22 and 23 slant their lower inner front edges further out from one another, than the upper inner front edges of the panels 22 and 23 when the device is flat before being attached to a person. The device 20, including the front and rear panels will be formed of flexible plastic imperforate material.

The panel 22 has a projecting flexible strap 30 attached to the neck thereto with velcro 30' attached to the inside of the strap. The strap 30 is attached to the neck or collar portion 25 of the panel 23.

Figure 3:
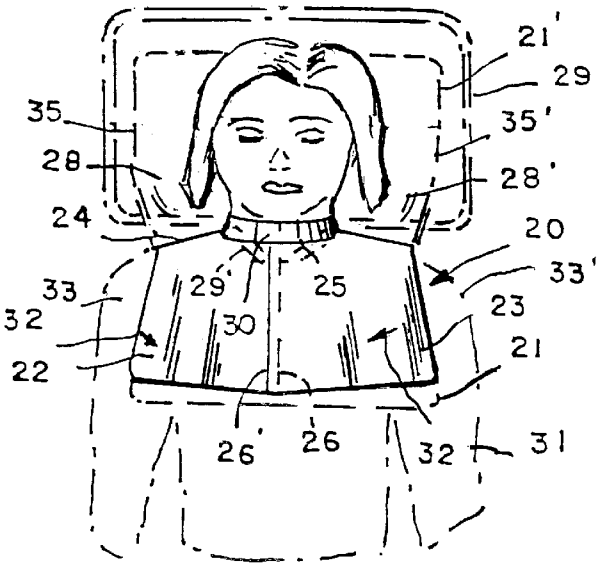
FIG. 3 is a front view of the shampoo cape invention illustrating the shampoo invention as initially attached to the wearer in solid lines, and illustrating the side edges of the rear panel turned up to provide a channel for guiding shampooing fluids when shampooing the wearer's hair.

The velcro 30" attached along its upper inner edge of the strap is to be engaged by the velcro 30' on the neck or collar portion 25 of panel 22 to attach the strap 30 to tie collar portion of panel 22 and thereby attach panel 23 to panel 22 as shown in FIG. 3.

The cape device 20 is initially attached to a person seeking a shampoo, as illustrated in FIG. 3, by draping the back panel 21 of the device on the back of the person, and wrapping the front panels 22 and 23 around the shoulders of the person 31 and securing the front panels together by about the front of the neck of the person 31 by applying the velco tape on the strap 30' on panel 23 to the velcro 30' on the neck portion of panel 22. The attachment of the strap 30 of panel 23 to the neck portion of panel 22 will act to draw the panels 22 and 23 toward one another as shown in FIG. 3 by arrows 32 and will act to hold the cape about the shoulders of the person, as well as cause the cape 20, initially, to conform to the shoulders of the wearer and drape downward and outward closely about the shoulder of the wearer to slant outward and downward along lines 24 and 24' as shown in FIG. 3, toward the outer edges 26' of the device to form downwardly directed inverted cup or pocket like shapes 28 and 28' to conform closely about and to the shape of the shoulders 33 and 33' of a wearer 31, when the cape device 20 is initially attached to the wearer, before its use for shampooing.

After the cape is initially attached to the person, the rear panel 21 will be raised above the front panels to its position 21' as shown in phantom lines 34, and the outer top edges 35 and 35' of the panels on each side of th device 20 will be flexed and inverted to their upward position as shown in phantom lines 34 in FIG. 3; to cause them to form an upward extending channels or shallow pockets 28 in the rear panel 21 on each side of the rear panel, which channels 28 and 28' formed on each side extending rearward along the rear panel 21. These provide an upward outer ridges 35 and 35' to the on the rear panel each side of the rear panel from adjacent panels 22 and 23 and rearward.

Figure 4:
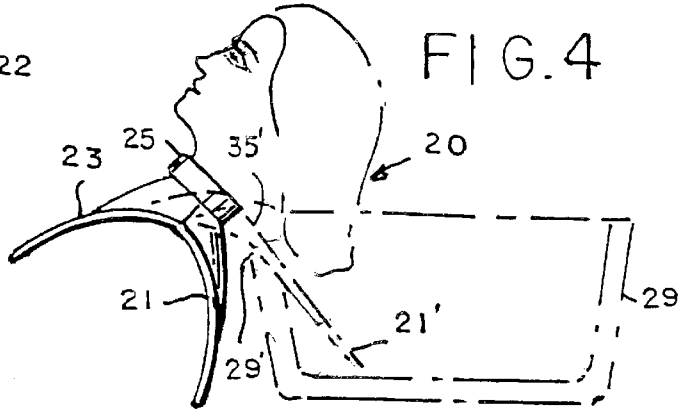
FIG. 4 is a side view of the shampoo cape invention illustrating in solid lines, the cape as initially attached to the wearer, and illustrating in phantom lines, the side edges of the rear panel and front panel turned up to provide channels for guiding the shampooing fluids into a sinks.

The lower portions 36 of the inner front edges 26 and 26' of the front panels 21 and 22 are not secured together to facilitate the inner edges 26 and 26' being drawn apart from one another, after the device has been attached to the wearer and when raising the rear panel 21 upward, and inverting the downward directed cup like shape to their upward positions 28 as shown in phantom lines in FIGS. 3 and 4.

Once the cape device has been attached to the person, and the rear panel raised upward above the head of the wearer and the upward directed channels 28 formed; the person 31 may be leaned rearward and back ward over a shampoo sink 29 as illustrated in FIGS. 3 and 4, and the upward and rearward extending outer edges 28 and 28' of the rear panel of the cape will provide ridges which will act to prevent the fluids used, during shampooing, from running off the sides 35 and 35' of the rear panel. Rather they will tend to cause the fluids to run rearward along the rear panel 21 of the rear edge 37 of the rear panel 21 into the shampoo sink 29, guided by the upward extending edges 28 and 28' of the rear panel.

Conventional shampoo sinks 29 have a downward notched area 29' in their front wall to receive the neck of the wearer and which also act to guide and facilitate the outer edges 35 and 35' of the rear panel upward to form the channels 28 and 28'.

Further, the front panels 21 and 22 are not connected to the rear panel 23 below the outer ends of slanted sewing lines 24 and 24' or in other words below the arm pits location 31' of the wearer act to also facilitate the inverting of the cup portions 28 and 28' being inverted upward to their positions shown in phantom lines 34.

Thus it will be seen that a novel shampooing cape has been provided with novel guide structure along its shoulder portions and along the outside rear portions of the rear panel of the cape which act to guide the shampooing fluids more directly into the sink, and which acts to minimize the possibility of the fluids flowing laterally off the laterally off the rear panel onto the floor beside the sink.

It will be obvious that various changes and departures may be made to the invention without departing from the spirit and scope thereof, and accordingly, it is not intended that the invention be limited to that specifically described in the specification or as illustrated in the drawing but only as set forth in the appended claims wherein.

What is claimed is:

1. A shampoo cape device comprising a single rectangular rear panel having front, rear, and laterally opposing sides; a pair of at least four sided front panels including one of said sides diagonal to at least two of the remaining sides; said diagonal side of each front panel attached along the front side of said rear panel; said two of said sides of each of said front panels converging forward toward one another to form a pointed configuration and diverging rearward from one another; one of said two sides of each front panel being adjacent one another along substantially straight lines and diverging forward away from one another; a strap to secure the rearward end of each one of said two sides of said front panels, so that the device may be applied over a wearer's shoulders with said diagonal connections resting upon the shoulders of the wearer; the strap will secure the rearward end of each one of said two sides of said front panels about the neck of the wearer forming an up-turned collar and so that the one of said two sides will be drawn substantially parallel to one another and overlapping one another continuously along their length to provide a continuous closed surface across the front of the wearer; said front panels extending downward along the front of the wearer below the shoulders of the wearer to at least adjacent the wearer's armpits provide a vest like configuration to front of the device when worn by the wearer, with said front panels free of said rear panel below the diagonal connection and adjacent the arm pits of the wearer, so that the panels may be raised up about the diagonal connection to the front panel to form channels along the lateral sides of the rear panel toward the rear of the rear panel and the person to which the device is attached may be rested rearward in a sink and the upward formed channels will tend to direct fluids applied to the head of the wear along the rear panel into the sink.

2. A shampoo cape for attachment to a wearer comprising a single rectangular rear panel having front, rear, and laterally opposing sides, a pair of at least four sided front panels with one of said sides in each panel diagonal to at least two of the remaining sides, said diagonal side of each front panel attached along the front side of said rear panel with space between the front panels for a center opening, furned an cup-furned collar about said opening, one said two sides of each of said front panels being substantially straight and laterally adjacent one another and diverging forward away from one another and converging rearward toward one another, a strap to secure the rearward end connection resting of said laterally adjacent one of said two sides;

so that the device may be applied over the wearer's shoulders with said diagonal connection resting upon the shoulders of the wearer; and so that said strap will act to secure the rearward end of each one of said two sides of said front panels together with the collar closely about the neck of the wearer, with said securing of the rearward ends together causing the adjacent one of the two sides of the front panels to be drawn substantially parallel to one another and overlapping one another at least substantially continuously along their length to provide a continuous closed surface laterally across the front of the wearer;

said front panels, when said device is upon a wearer, extending downward to at least adjacent the arm pits of the wearer to provide a closed vest like configuration to the front of the device upon the wearer with the collar closely about the neck of the wearer;

said front panels being substantially free of said rear panels below the diagonal connection and in the area adjacent the arm pits of the wearer, so that said panels may be raised about the diagonal connections to form channels alone the lateral sides of the rear panel extending toward the rear side of the rear panel, and the wearer to which the device is attached may rest then rearward in a sink and the upward channels will tend to direct fluids applied to the wearer's head rearward along the rear panel into the sink.

3. A shampoo cape device according to claim 2, wherein said collar is secured about the center area of the front and rear panels and extends laterally upward from the panels.

* * * * *